US007900706B2

(12) United States Patent
Ford

(10) Patent No.: US 7,900,706 B2
(45) **Date of Patent: *Mar. 8, 2011**

(54) SHOULDER RING SET ON CASING HANGER TRIP

(75) Inventor: David L. Ford, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 1137 days.

This patent is subject to a terminal disclaimer.

(21) Appl. No.: 11/408,387

(22) Filed: Apr. 21, 2006

(65) Prior Publication Data

US 2006/0231248 A1 Oct. 19, 2006

Related U.S. Application Data

(63) Continuation-in-part of application No. 11/189,387, filed on Jul. 26, 2005, now Pat. No. 7,150,323.

(60) Provisional application No. 60/591,067, filed on Jul. 26, 2004.

(51) Int. Cl.
*E21B 29/12* (2006.01)

(52) U.S. Cl. ..... 166/348; 166/368; 166/212; 166/208; 285/123.4

(58) Field of Classification Search ..... 166/341, 166/344, 345, 348–350, 367, 368, 208, 212; 285/123.2, 123.4

See application file for complete search history.

(56) References Cited

U.S. PATENT DOCUMENTS 3,603,401 A * 9/1971 Nelson et al. ..... 166/313
3,664,689 A * 5/1972 Hanes ..... 285/18
3,827,488 A * 8/1974 Piazza et al. ..... 166/208
3,913,670 A * 10/1975 Ahlstone ..... 166/182
3,918,747 A * 11/1975 Putch ..... 285/4
3,944,273 A * 3/1976 Ahlstone ..... 294/86.1
4,030,544 A * 6/1977 Ahlstone ..... 166/182
4,181,331 A 1/1980 Cowan
4,540,053 A * 9/1985 Baugh et al. ..... 166/348
4,569,404 A 2/1986 Milberger et al.
4,641,708 A 2/1987 Wightman
4,691,780 A 9/1987 Galle et al.
4,697,828 A * 10/1987 Chou ..... 285/18
4,719,971 A * 1/1988 Owens ..... 166/191
4,722,391 A * 2/1988 Brammer ..... 166/195
4,751,965 A * 6/1988 Cassity ..... 166/182
4,757,860 A 7/1988 Reimert
4,791,992 A * 12/1988 Greenlee et al. ..... 166/387
4,815,770 A * 3/1989 Hyne et al. ..... 285/123.12
4,823,871 A * 4/1989 McEver et al. ..... 166/182
4,842,061 A * 6/1989 Nobileau ..... 166/115
4,903,992 A 2/1990 Jennings et al.
4,911,244 A 3/1990 Hynes
4,982,795 A * 1/1991 King ..... 166/382
5,060,724 A 10/1991 Brammer et al.
5,066,048 A 11/1991 Farrell
5,163,514 A * 11/1992 Jennings ..... 166/368
(Continued)

*Primary Examiner* — Thomas A Beach
(74) *Attorney, Agent, or Firm* — Bracewell & Giuliani

(57) ABSTRACT

A wellhead housing has a bore with a support shoulder, a ramp surface extending upward and outward from the support shoulder, and a recess extending upward from the ramp. A split, resilient load ring is carried in an initial position in the recess. A retractable and axially movable latch ring is carried in the recess above the load ring. A casing hanger has a profile that engages the latch ring as the casing hanger moves downwardly in the bore, causing the latch ring to move downward and pushing the load ring to the set position.

20 Claims, 6 Drawing Sheets

U.S. PATENT DOCUMENTS 5,247,996 A * 9/1993 Milberger ..... 166/348
5,307,879 A * 5/1994 Kent ..... 166/382
6,003,602 A * 12/1999 Wilkins ..... 166/339
6,302,211 B1 10/2001 Nelson et al.
6,598,673 B1 7/2003 Hosie et al.
7,025,145 B2 * 4/2006 Emmerson ..... 166/348
7,028,777 B2 * 4/2006 Wade et al. ..... 166/343

* cited by examiner

SHOULDER RING SET ON CASING HANGER TRIP

RELATED APPLICATIONS

This non-provisional application is continuation-in-part patent application that claims the benefit of co-pending, non-provisional patent application U.S. Ser. No. 11/189,387, now U.S. Pat. No. 7,150,323, filed on Jul. 26, 2005, which claimed priority to provisional application 60/591,067 filed Jul. 26, 2004, both of which are hereby incorporated by reference in their entirety.

BACKGROUND OF THE INVENTION

1. Field of the Invention

This invention relates in general to subsea wellhead assemblies, and in particular to a full bore wellhead housing, wherein the operator sets a casing hanger load shoulder ring during the casing hanger running procedure.

2. Background of the Invention

A typical subsea well has a wellhead housing at the upper end of the well. The wellhead housing is a tubular member having a bore. A string of large diameter casing attaches to the lower end of the wellhead housing and extends into the well. After further drilling through the wellhead housing, a smaller diameter string of casing is installed. A casing hanger at the upper end of the smaller diameter string of casing lands in the bore on a load shoulder.

In one type of wellhead housing, the load shoulder is permanently formed in the bore during manufacturing. This permanent load shoulder reduces the diameter of the bore below the load shoulder. In some instances, a full diameter is desired for the entire length of the bore. It has been proposed to install a split load ring in the bore before running the first casing hanger to provide a load shoulder. However, running the load ring on a running tool would require an extra trip from the drilling rig to the sea floor. In very deep water, the extra trip would be expensive.

In another technique, a split load ring is secured in a contracted diameter position to the casing hanger. When the casing hanger enters the bore, the load ring moves to a set position on a support shoulder provided in the bore.

SUMMARY OF THE INVENTION

In this invention, a support shoulder is located in the wellhead housing. The support shoulder has an inner diameter equal or greater than the full bore of the wellhead housing and is located at the lower end of a recess. A split, resilient load ring is carried in an expanded diameter initial position in the recess above the support shoulder. The load ring is movable downwardly in the recess to a set position in engagement with the support shoulder. When moving downward, the load ring contracts to a smaller diameter.

An actuator is carried in the bore above the load ring for moving the load ring from the initial position to the set position. The casing hanger is provided with a profile that engages the actuator while being lowered into the wellhead housing. Continued downward movement of the casing hanger causes the actuator to move the load ring to the set position. The casing hanger lands on the load ring as it moves to the set position.

A wellhead assembly has a wellhead housing with a bore containing a support shoulder. A split, resilient load ring carried in an expanded initial position in the bore above the support shoulder. The load ring is movable downwardly to a contracted set position in engagement with the support shoulder. An actuator assembly is carried in the bore above the load ring for pushing the load ring from the initial position to the set position. The actuator assembly has an axially resilient portion. A casing hanger is for securing to a string of casing and lowering into the wellhead housing. The casing hanger has an outer profile that engages the actuator assembly as the casing hanger moves downwardly in the bore, thereby causing the resilient portion to compress and the load ring to move to the set position. The casing hanger has an outer profile that engages the actuator assembly as the casing hanger moves downwardly in the bore, also causing the casing hanger to land on the load ring so that the load ring transfers weight from the casing hanger to the wellhead housing.

The resilient portion can have a serpentine cross-section. The resilient portion can have an initial axial length prior to the casing hanger engaging the actuator assembly that is greater than a compressed axial length of the resilient portion after being compressed by the downward movement of the casing hanger. The resilient portion can have a decompressed axial length upon removal of the casing hanger from the wellhead housing that is substantially the same as an initial axial length.

The load ring can have an engagement shoulder on an upper side, and at least a portion of the engagement shoulder has a larger diameter than an interior surface of the resilient portion to the casing hanger engaging the actuator assembly. The load ring can have an engagement shoulder on an upper side, and an interior surface of the resilient portion has a larger diameter than the engagement shoulder when the load ring is in the set position.

The actuator assembly can have an axially resilient ring and an actuator ring. The axially resilient ring can be positioned between the actuator ring and the load ring. The actuator ring can have an inner profile that engages the outer profile of the casing hanger. The actuator assembly can have an inner profile that engages the outer profile of the casing hanger and the axially resilient ring is positioned between the inner profile and the load ring.

A wellhead assembly has a wellhead housing with a bore that has an axis and a support shoulder. A ramp surface extends upward and outward from the support shoulder. The wellhead housing has a recess extending upward from the ramp. A split, resilient load ring is carried in an initial position in the recess. The load ring is movable downwardly on the ramp surface to a set position on the support shoulder. The load ring has an engagement shoulder on an upper side. An axially resilient ring is carried on the load ring. The wellhead assembly also has a casing hanger for securing to a string of casing and lowering into the wellhead housing. An outer profile on the casing hanger compresses the resilient ring as the casing hanger moves downwardly in the bore, thereby causing the resilient ring to move downward and push the load ring to the set position. And thereby casing hanger lands on the engagement shoulder of the load ring.

The load ring can have an inner diameter while in the initial position that is greater than an interior surface of the axially resilient ring while in the initial position. The axially resilient ring can be carried within the recess while the load ring is in the initial position. The axially resilient ring can have an initial axial length when the load ring is in the initial position that is greater than a compressed axial length of the spacer ring when the load ring is in the set position.

At least a portion of the engagement shoulder can have a larger inner diameter than an interior surface of the axially resilient ring when the load ring is in the initial position. The interior surface of the axially resilient ring can have a larger inner diameter than the engagement shoulder when the load ring is in the set position.

An actuator ring can be carried on the axially resilient ring. The actuator ring can be engaged by the casing hanger to compress the axially resilient ring. An interior surface of the actuator ring can be radially inward of the axially resilient ring. The actuator ring can be carried within the recess while the load ring is in the initial position, and at least a portion of the actuator ring can be carried within the recess while the load ring is in the set position.

A method for installing a casing hanger in a subsea wellhead housing having a bore includes providing a support shoulder in the bore of the wellhead housing. The method also includes the step of mounting a split, resilient load ring in an expanded initial position in the bore above the support shoulder. Then the method includes the step, mounting an actuator assembly having an axially resilient portion in the bore above the load ring. Then the method includes the step, lowering the wellhead housing into the sea and installing the wellhead housing at the upper end of a well. Then the method includes the step, securing a string of casing to a casing hanger and lowering the casing hanger into the wellhead housing. Finally, the method includes the step, compressing the axially resilient portion of the actuator assembly with the casing hanger and pushing the load ring downward, thereby causing the load ring to contract and land on the support shoulder and the casing hanger to land on the load ring.

DETAILED DESCRIPTION OF THE PREFERRED EMBODIMENT

Figure 1:
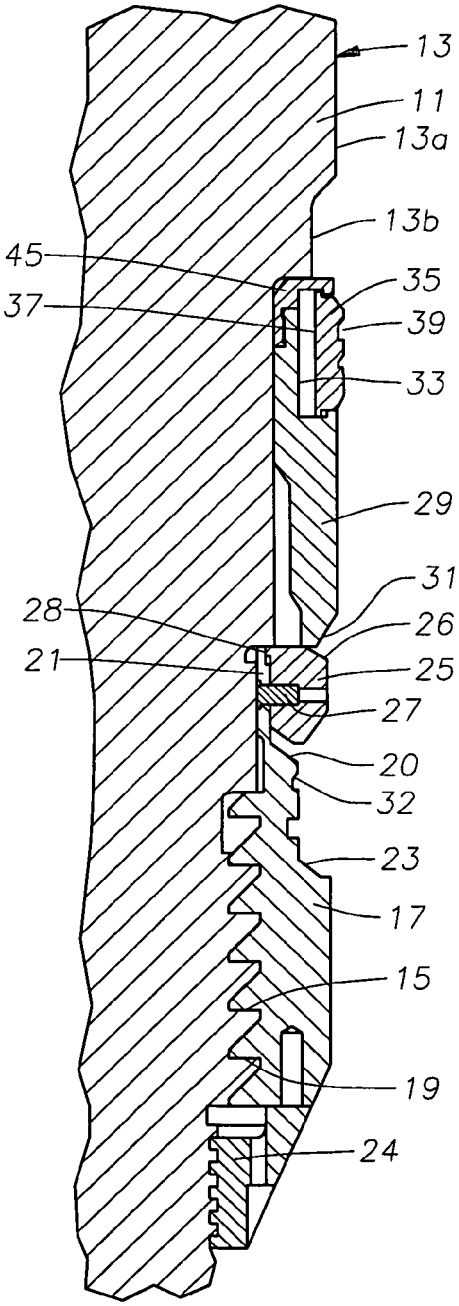
FIG. 1 is a vertical sectional view of a portion of a wellhead housing having a shoulder ring assembly located in a retracted position.

Referring to FIG. 1, wellhead housing 11 is a large tubular member that is typically located at the upper end of a well in a subsea location near the sea floor. Wellhead housing 11 has a bore 13 extending through it with an internally threaded profile 15. Bore 13 has a minimum inner diameter portion 13*a* and an enlarged diameter portion or recess 13*b* extending below.

A support ring 17 has external threads 19 that secure to threads 15 within wellhead housing bore portion 13*b*. Support ring 17 is a solid cylindrical member that is stationarily mounted to wellhead housing 11 prior to lowering wellhead housing 11 into the sea. Support ring 17 has an upward facing support shoulder 23, a ramp 20 above support shoulder 23, and a neck 21 extending upward from ramp 20. Neck 21 has a larger inner diameter than the smallest inner diameter bore portion 13*a*. A retainer ring 24 secures to a threaded profile formed in bore portion 13*b* below support ring 17. Retainer ring 24 retains support ring 17 in engagement with threaded profile 15. Support shoulder 23 has an inner diameter that is equal or greater than the inner diameter of portion bore 13*a*.

Figure 2:
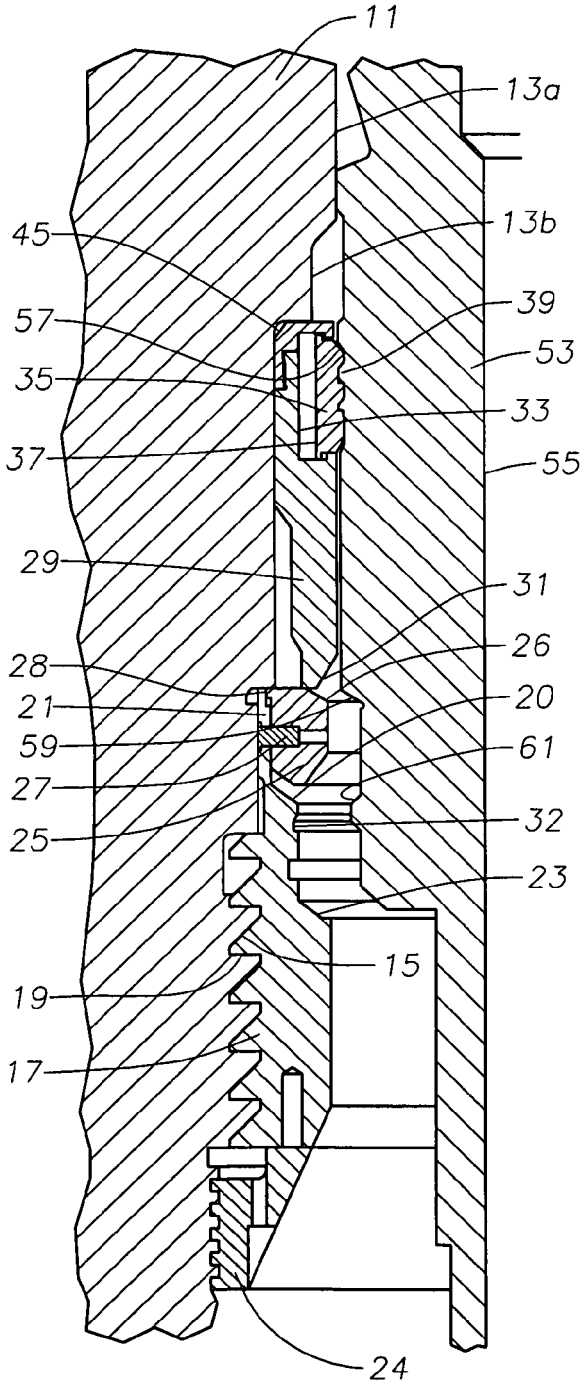
FIG. 2 is a sectional view of the portion of the wellhead housing of FIG. 1, and further showing a casing hanger in the process of engaging an actuator ring of the shoulder ring assembly.
Figure 4:
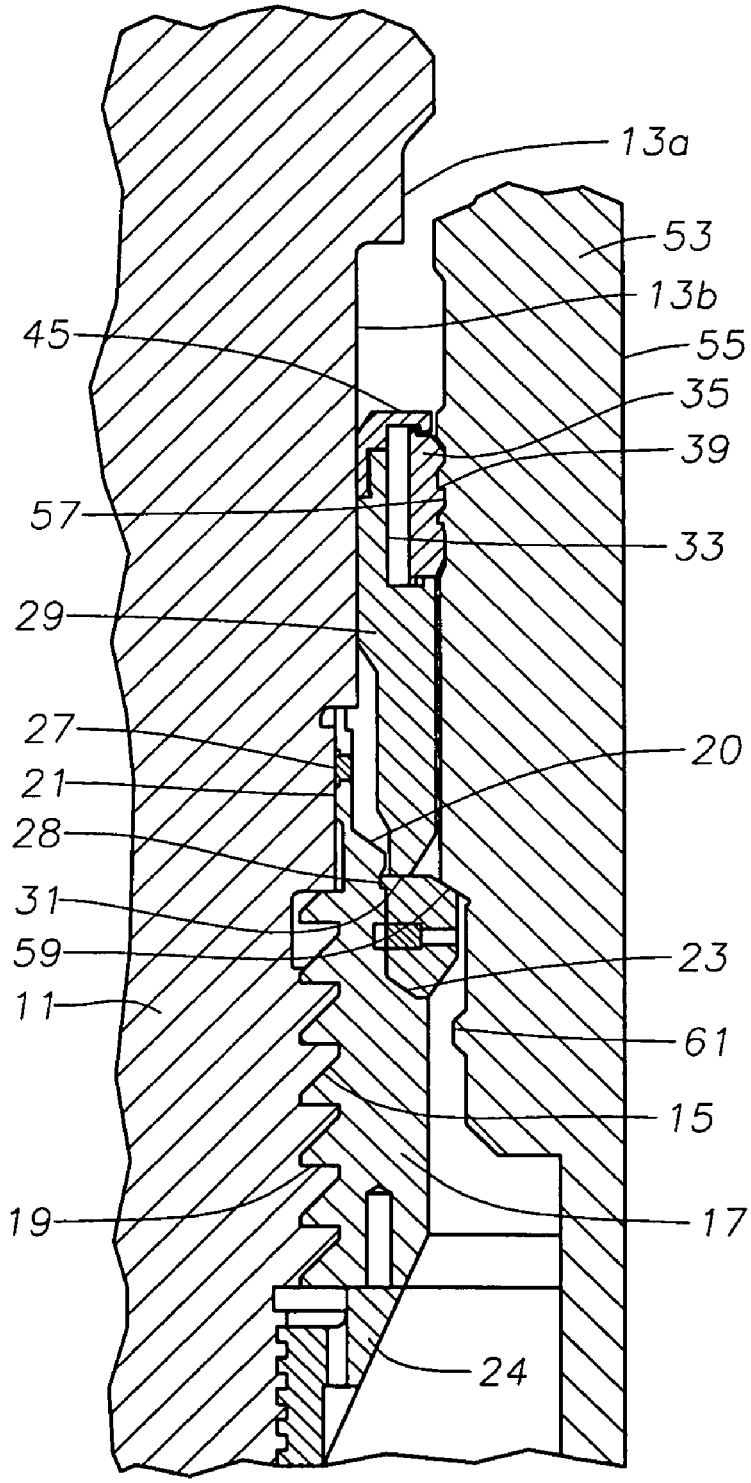
FIG. 4 is a sectional view of the portion of the wellhead housing of FIG. 1, showing the casing hanger and load shoulder ring in a fully landed position.

A split load ring 25 initially mounts to neck 21 by a shear pin 27. Shear pin 27 releasably retains load ring 25 in an initial diameter expanded position. Split load ring 25 is carried on the inner diameter of neck 21 initially in an upper position, as shown in FIGS. 1 and 2. Split load ring 25 is biased outward, and is movable from the upper position down ramp 20 to a set position on support shoulder 23, as shown in FIG. 4. In the lower position, load ring 25 is located farther inward than while in the upper retracted position. Split load ring 25 has an upward and inward facing engagement shoulder 26. The inner diameter of load ring 25 is equal or greater than the inner diameter of bore portion 13*a* while in the initial position, and less than bore portion 13*a* while in the set position.

Load ring 25 has a protruding band 28 on its outer diameter for snapping into engagement with a groove 32 formed on support ring 17 above support shoulder 23. Band 28 and groove 32 releasably fasten load ring 25 to support ring 17 when load ring 25 moves to its set position.

An actuator ring 29 is carried within recessed bore portion 13*b* for movement between an upper position shown in FIG. 1 and a lower position shown in FIG. 4. Actuator ring 29 is a rigid cylindrical member that has a lower end 31 in contact with an upper side of load ring 25. In the example shown, an outer diameter portion of actuator ring 29 at lower end 31 is spaced inward a selected distance from the sidewall of bore portion 13*b*. Actuator ring 29 and load ring 25 are also mounted in bore portion 13*b* prior to lowering wellhead housing 11 into the sea. Actuator ring 29 has an annular recess 33 formed within its inner diameter.

A latch ring 35 is movably carried within recess 33. Latch ring 35 is a split ring that is inward biased. Latch ring 35 has an outer diameter 37 that is spaced radially inward from the cylindrical base of recess 33. Latch ring 35 has a profile 39 formed on its inner diameter that comprises a selected pattern of grooves and lands. In the initial position, profile 39 protrudes inward a short distance past the inner diameter of actuator ring 29. Also, the inner diameter of profile 39 is slightly less than the inner diameter of bore portion 13*a*.

Figure 5:
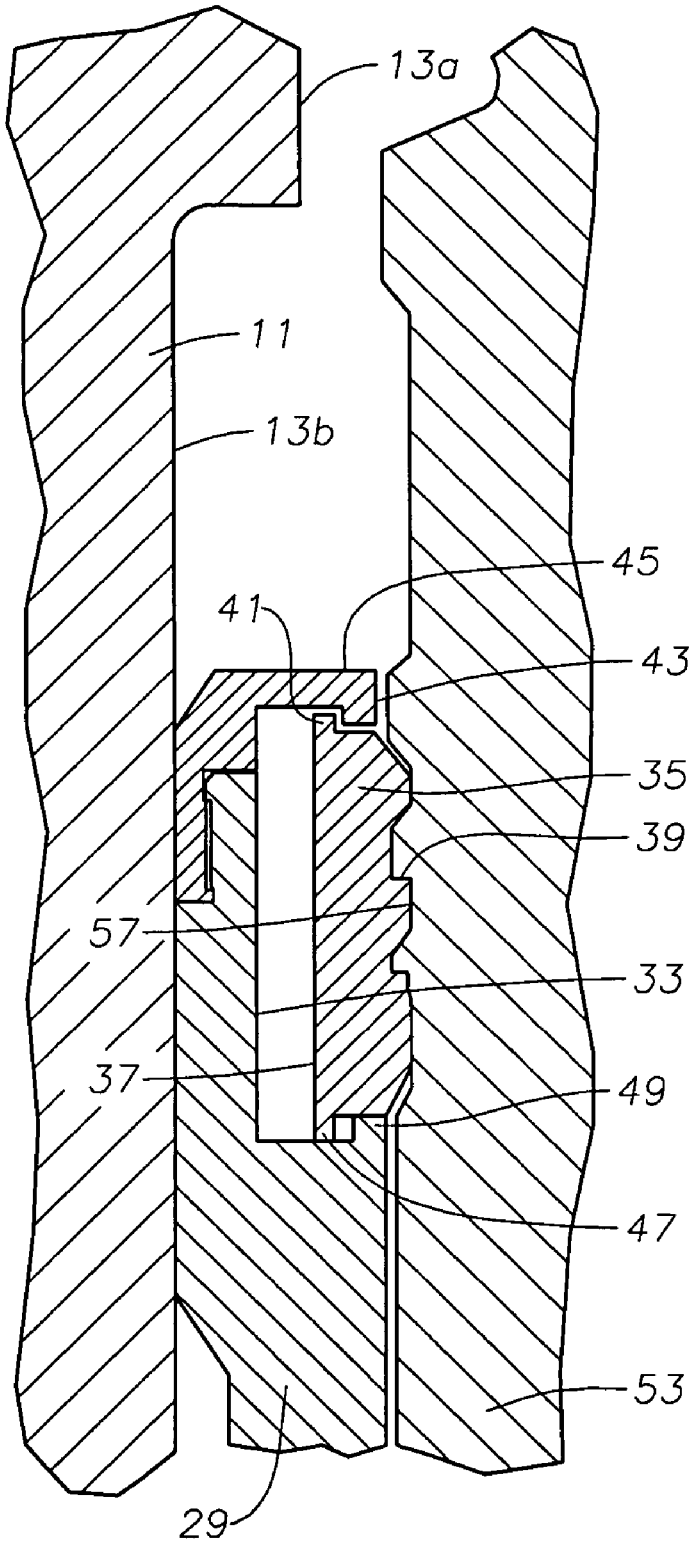
FIG. 5 is an enlarged sectional view of part of the actuator assembly after the casing hanger has fully landed.

Referring to FIG. 5, latch ring 35 has an upward protruding rim 41 located on its inner diameter 37. Upper rim 41 locates on the outer side of a downward protruding lip 43 of a retainer cap 45. Latch ring 35 has a downward protruding lower rim 47 on its lower end at its outer diameter 37. Lower rim 47 locates radially outward from an upward protruding lower lip 49, which is formed in recess 33. Lips 43 and 49 and rims 41 and 47 retain latch ring 35 within recess 33, but allow radial movement. Lower rim 47 is sufficiently thin so as to buckle or crush under the weight of casing, as will be subsequently explained. Retainer cap 45 is secured to an upper portion of actuator ring 29, such as by threads.

When the operator wishes to run casing, the operator secures a casing hanger 53, shown in FIG. 2, to the casing and lowers it through a riser (not shown) and into the well. Casing hanger 53 has a bore 55 and an external profile 57. Profile 57 comprises a plurality of grooves and lands that match profile 39 of latch ring 35. Because of the protrusion of latch ring 35, when profile 57 aligns with profile 39, latch ring 35 will snap into engagement with casing hanger 53, as shown in FIG. 2. Casing hanger 53 has a downward facing shoulder 59 that is at an angle for mating with engagement shoulder 26 on the upper surface of load ring 25. When load ring 25 lands on support shoulder 23, as shown in FIG. 4, casing hanger shoulder 59 will be in mating abutment with engagement shoulder 26 of load ring 25. Band 28 on load ring 25 will snap into engagement with groove 32, preventing upward movement of load ring 25.

Casing hanger 53 may have a protruding rib or band 61 formed on its outer diameter below load shoulder 59 for providing a feedback to determine that band 28 on load ring 25 has latched into the groove 32 of support ring 17. After load ring 25 has locked into groove 32, the operator can lift casing hanger 53 a short distance to test whether the engagement was properly made. While lifting, rib 61 will contact load ring 25 and exert an upward force. The operator can exert an overpull above the weight of the casing string to an amount less than what would be required to completely pull load ring 25 from support shoulder 23.

Figure 3:
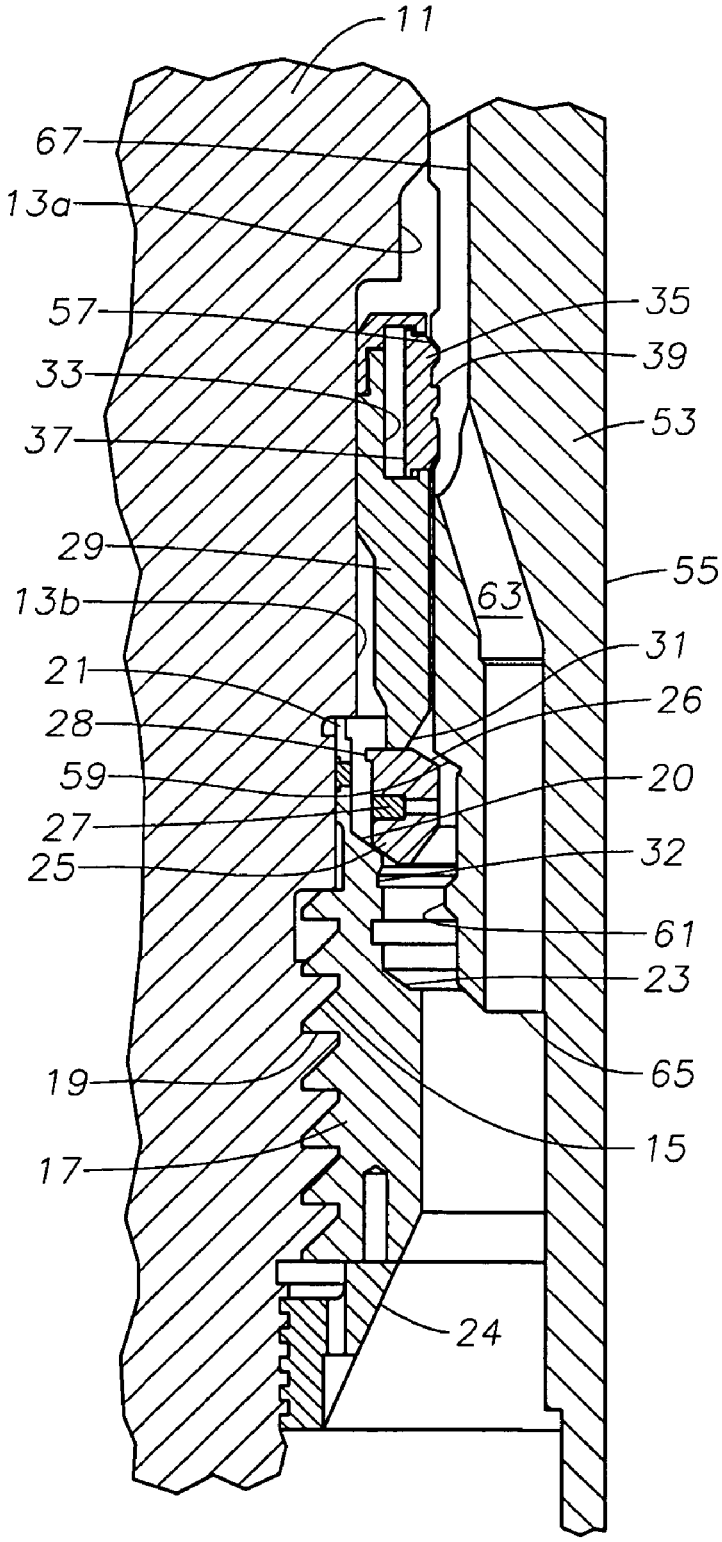
FIG. 3 is a sectional view of the portion of the wellhead housing of FIG. 1, showing the casing hanger moving the actuator ring and the load shoulder ring downward.

Casing hanger 53 has a plurality of flow passages 63 (only one shown) that are illustrated in FIG. 3, but for clarity, are not shown in the other views. Flow passages 63 extend from a lower shoulder 65 upward to the vicinity of profile 57. Each flow passage 63 joins a channel 67 that extends along the outer diameter of casing 53. Flow passages 63 and channels 67 serve for returning flow during cementing.

In operation, the components shown in FIG. 1 will be assembled at the factory, at a field site or on a drilling rig, prior to lowering wellhead housing 11 into the sea. Preferably, the operator installs a wear bushing or protective sleeve over support ring 17 and actuator ring 29. Wellhead housing 11 is installed in a conventional manner, typically within an outer wellhead (not shown) that is secured to conductor pipe extending into an upper portion of the well. Wellhead housing 11 will be secured to a string of large diameter casing and lowered into the well to a selected depth. The operator connects wellhead housing 11 to a drilling riser and blowout preventer and continues drilling through wellhead housing 11 to the desired depth.

After the drilling has been completed, the operator removes the wear bushing, preferably on the last trip of the drill bit. The operator then lowers a string of casing on casing hanger 53. As casing hanger 53 aligns with actuator ring 29, its profile 57 will engage profile 39 of latch ring 35.

Continued downward movement causes shear pin 27 to shear as shown in FIG. 3. Load ring 25 slides down ramp 20 and inward to the set position of FIG. 4, where it latches into place on support shoulder 23. Casing hanger shoulder 59 will abut load ring 25. Lower rim 47 (FIG. 5) will crush or buckle under the weight imposed by casing hanger 53. This deformation causes the weight of the string of casing to bypass latch ring 35 and actuator ring 29 and pass directly from casing hanger 53 through shoulder 59, load ring 25, support ring 17 and into wellhead housing 11. The operator cements the casing in a conventional manner.

The invention has significant advantages. While in the initial position, the load ring provides full bore access during initial drilling operations. When needed, the load ring is moved to the set position, providing a load shoulder smaller than the diameter of the bore of the housing above the load ring. The movement to the set position occurs automatically when the casing hanger is being installed. An additional trip to move the load ring to the set position is not required.

Figure 6:
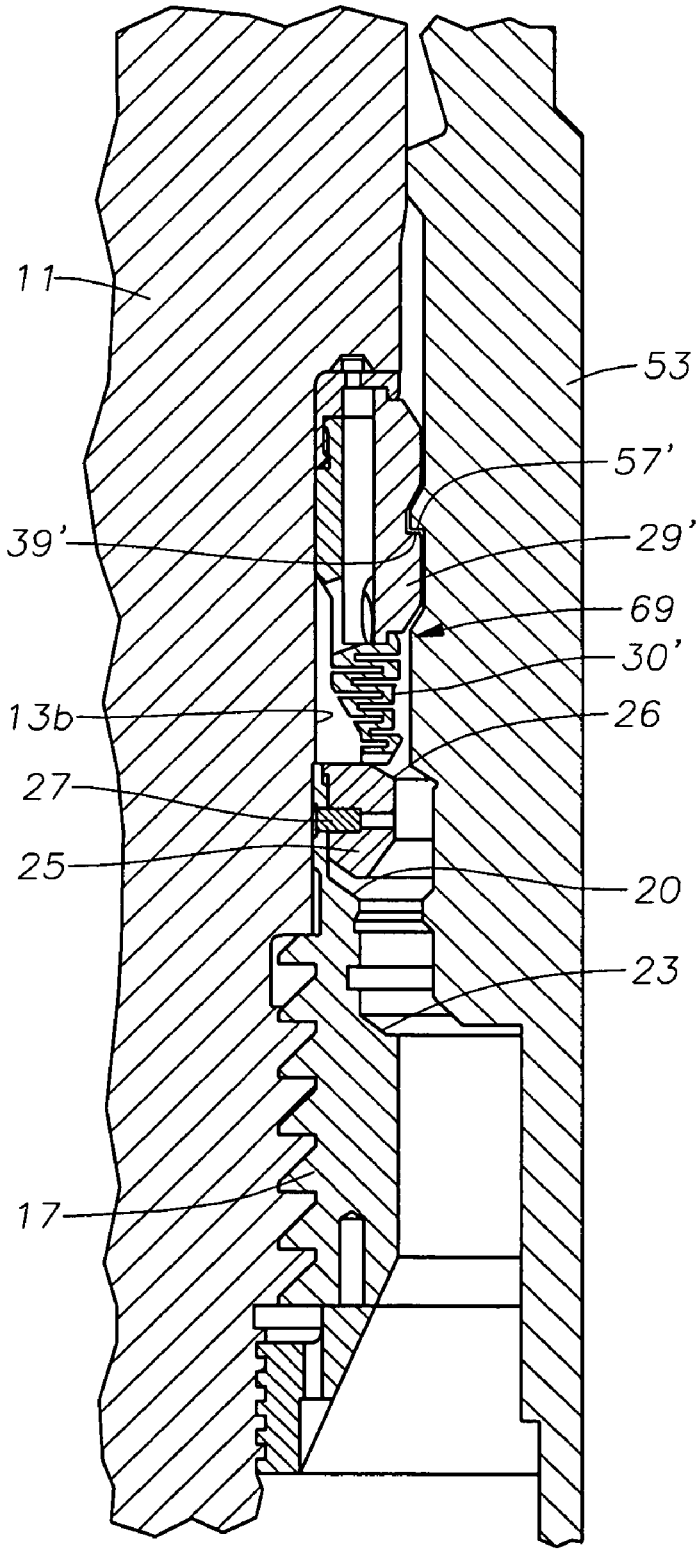
FIG. 6 is a vertical sectional view of an alternative portion of a wellhead housing having a shoulder ring assembly located in a retracted position, and further showing a casing hanger in the process of engaging an actuator ring of the shoulder ring assembly.
Figure 7:
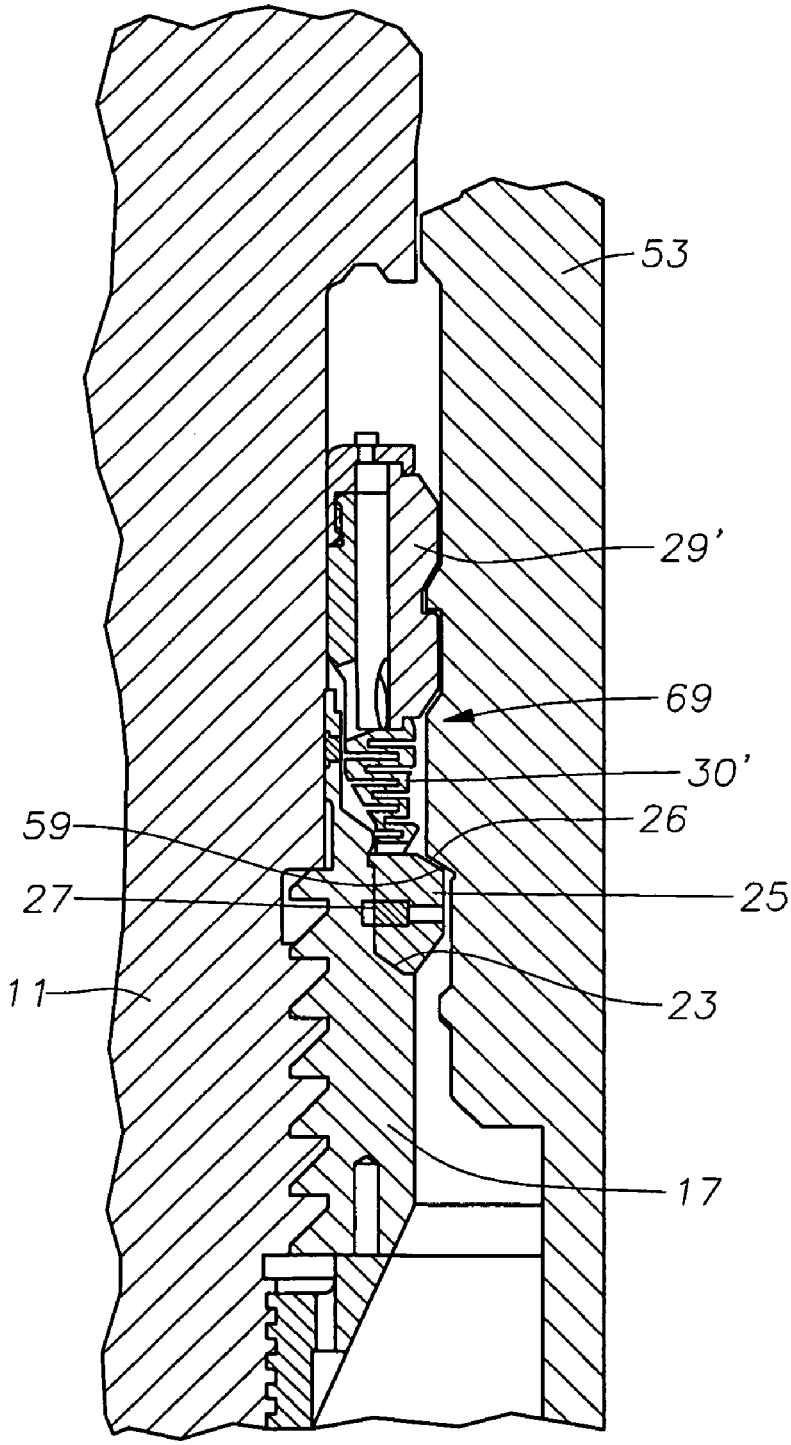
FIG. 7 is a sectional view of the portion of the wellhead housing of FIG. 6, showing the casing hanger and load shoulder ring in a fully landed position.

Referring to FIGS. 6 and 7, an alternative embodiment 69 is shown for an actuation assembly that actuates or pushes split load ring 25 downward from its initial position shown in FIG. 6, to its set position shown in FIG. 7 when casing hanger 53 is lowered into wellhead housing 11. Actuation assembly 69 preferably comprises an actuator ring 29' and an axial resilient portion 30'. As shown in FIGS. 6 and 7, axial resilient portion 30' can be an axially resilient ring. The ring forming axial resilient portion 30' in FIGS. 6 and 7 preferably comprises a serpentine-shaped cross-section. As will be readily appreciated by those skilled in the art, an axially resilient portion such as a serpentine-shaped cross section could also be integrally formed in an actuator ring so that actuation assembly 69 comprises only one ring rather than two separate rings 29', 30'.

Load ring 25 preferably has an inner diameter that is larger than the inner diameters of actuator ring 29' and axially resilient portion 30'. A profile 39' is formed on an inner surface of actuator assembly 29' for engagement with a profile 57' of casing hanger 53 when casing hanger 53 is lowered into wellhead housing 11. Profile 39' is located above axially above axially resilient portion 30'. In the preferred embodiment, profile 39' is formed on the interior surface of actuator ring 29' so that casing hanger 53 engages actuator ring 29', which in turn pushes downward on axially resilient portion 30' as casing hanger 53 continues moving downward into wellhead housing 11.

Resilient portion 30' compresses and pushes load ring 25 axially downward from its initial position, thereby shearing pin 27 so that load ring can contract radially inward and move axially downward along ramp 20 to upward facing support shoulder 23. Upon landing on support shoulder 23, as shown in FIG. 7, load ring 25 is in its contracted, set position. Resilient portion 30' compresses so that casing hanger load shoulder 59 lands directly on engagement shoulder 26 of load ring 25. The compression of resilient portion 30' allows the weight from casing hanger 53 and any string supported therefrom to be transferred directly from casing hanger load shoulder 59 to engagement shoulder 26, rather than through actuator assembly 69. Therefore, the weight associated with casing hanger 53 and the string of casing supported therefrom, is transferred straight through load ring 25 to support ring 17 and wellhead housing 11. Upon removal of casing hanger 53, axially resilient portion 30' extends to its original length and can be used again.

While the invention has been shown in only one of its forms, it should be apparent to those skilled in the art that it is not so limited but is susceptible to various changes without departing form the scope of the invention.

That claimed is:

1. A wellhead assembly, comprising:

a wellhead housing having a bore containing a support shoulder;

a split, resilient load ring carried in an expanded initial position in the bore above the support shoulder, the load ring being movable downwardly to a contracted set position in engagement with the support shoulder;

an actuator assembly carried in the bore above the load ring for pushing the load ring from the initial position to the set position, the actuator assembly having an axially resilient portion; and a casing hanger for securing to a string of casing and lowering into the wellhead housing, the casing hanger having an outer profile that engages the actuator assembly as the casing hanger moves downwardly in the bore, causing the resilient portion to compress and the load ring to move to the set position and causing the casing hanger to land on the load ring so that the load ring transfers weight from the casing hanger to the wellhead housing.

2. The wellhead assembly according to claim 1, wherein the resilient portion has a serpentine cross-section.

3. The wellhead assembly according to claim 1, wherein the resilient portion has an initial axial length prior to the casing hanger engaging the actuator assembly that is greater than a compressed axial length of the resilient portion after being compressed by the downward movement of the casing hanger.

4. The wellhead assembly according to claim 3, wherein the resilient portion has a decompressed axial length upon removal of the casing hanger from the wellhead housing that is substantially the same as an initial axial length.

5. The wellhead assembly according to claim 1, wherein the load ring comprises an engagement shoulder on an upper side, and at least a portion of the engagement shoulder has a larger diameter than an interior surface of the resilient portion to the casing hanger engaging the actuator assembly.

6. The wellhead assembly according to claim 1, wherein the load ring comprises an engagement shoulder on an upper side, and an interior surface of the resilient portion has a larger diameter than the engagement shoulder when the load ring is in the set position.

7. The wellhead assembly according to claim 1, wherein the actuator assembly comprises an axially resilient ring and an actuator ring, the axially resilient ring being positioned between the actuator ring and the load ring.

8. The wellhead assembly according to claim 1, wherein the actuator assembly comprises an axially resilient ring and an actuator ring, the actuator ring having an inner profile that engages the outer profile of the casing hanger.

9. The wellhead assembly according to claim 1, wherein the actuator assembly comprises an inner profile that engages the outer profile of the casing hanger and the axially resilient ring being positioned between the inner profile and the load ring.

10. A wellhead assembly, comprising:

a wellhead housing having a bore with an axis and containing a support shoulder, a ramp surface extending upward and outward from the support shoulder, and a recess extending upward from the ramp;

a split, resilient load ring carried in an initial position in the recess, the load ring being movable downwardly on the ramp surface to a set position on the support shoulder, the load ring having an engagement shoulder on an upper side;

an axially resilient ring carried on the load ring;

a casing hanger for securing to a string of casing and lowering into the wellhead housing; and an outer profile on the casing hanger that compresses the resilient ring as the casing hanger moves downwardly in the bore, causing the resilient ring to move downward and push the load ring to the set position, whereupon the casing hanger lands on the engagement shoulder of the load ring.

11. The wellhead assembly according to claim 10, wherein the load ring has an inner diameter while in the initial position that is greater than an interior surface of the axially resilient ring while in the initial position.

12. The wellhead assembly according to claim 10, wherein the axially resilient ring is carried within the recess while the load ring is in the initial position.

13. The wellhead assembly according to claim 10, wherein the axially resilient ring has an initial axial length when the load ring is in the initial position that is greater than a compressed axial length of the spacer ring when the load ring is in the set position.

14. The wellhead assembly according to claim 10, wherein at least a portion of the engagement shoulder has a larger inner diameter than an interior surface of the axially resilient ring when the load ring is in the initial position, and the interior surface of the axially resilient ring has a larger inner diameter than the engagement shoulder when the load ring is in the set position.

15. The wellhead assembly according to claim 10, further comprising an actuator ring carried on the axially resilient ring, the actuator ring being engaged by the casing hanger to compress the axially resilient ring.

16. The wellhead assembly according to claim 15, wherein an interior surface of the actuator ring is radially inward of the axially resilient ring.

17. The wellhead assembly according to claim 16, wherein the actuator ring is carried within the recess while the load ring is in the initial position, and at least a portion of the actuator ring is carried within the recess while the load ring is in the set position.

18. A method for installing a casing hanger in a subsea wellhead housing having a bore, comprising:

(a) providing a support shoulder in the bore of the wellhead housing;

(b) mounting a split, resilient load ring in an expanded initial position in the bore above the support shoulder;

(c) mounting an actuator assembly having an axially resilient portion in the bore above the load ring; then (d) lowering the wellhead housing into the sea and installing the wellhead housing at the upper end of a well; then (e) securing a string of casing to a casing hanger and lowering the casing hanger into the wellhead housing; and (f) compressing the axially resilient portion of the actuator assembly with the casing hanger and pushing the load ring downward, causing the load ring to contract and land on the support shoulder and the casing hanger to land on the load ring.

19. The method according to claim 18, wherein step (c) further comprises: mounting an axially resilient ring in the bore above the load ring, and then mounting an actuator ring in the bore above axially resilient ring.

20. The method according to claim 19, wherein:

step (f) comprises engaging the actuator ring with the casing hanger as the casing hanger is lowered into the wellhead housing.

* * * * *